US007509938B2

(12) United States Patent
Morimoto et al.

(10) Patent No.: US 7,509,938 B2
(45) Date of Patent: Mar. 31, 2009

(54) INTERNAL COMBUSTION ENGINE CONTROL APPARATUS

(75) Inventors: Youhei Morimoto, Kariya (JP); Akikazu Kojima, Gamagoori (JP); Hiroshi Haraguchi, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/822,936

(22) Filed: Jul. 11, 2007

(65) Prior Publication Data

US 2008/0022976 A1 Jan. 31, 2008

(30) Foreign Application Priority Data

Jul. 28, 2006 (JP) ..... 2006-205558

(51) Int. Cl.
*F02D 41/30* (2006.01)

(52) U.S. Cl. ..... 123/299; 123/435; 123/478

(58) Field of Classification Search ..... 123/299, 123/435, 478, 480, 674, 698; 701/104, 105, 701/109

See application file for complete search history.

(56) References Cited

U.S. PATENT DOCUMENTS 5,131,371 A * 7/1992 Wahl et al. ..... 123/436
5,526,788 A * 6/1996 Noble et al. ..... 123/406.37
5,535,722 A * 7/1996 Graessley et al. ..... 123/406.21
7,036,482 B2 * 5/2006 Beck et al. ..... 123/229
7,117,082 B2 10/2006 Kohira et al.
7,146,964 B2 12/2006 Norimoto et al.
7,231,289 B2 * 6/2007 Damitz et al. ..... 701/104
7,370,616 B2 * 5/2008 Kuo et al. ..... 123/90.15
7,424,868 B2 * 9/2008 Reckels et al. ..... 123/41.1

FOREIGN PATENT DOCUMENTS

JP 2000-192836 7/2000
JP 2005-351161 12/2005
JP 2006-144639 6/2006

* cited by examiner

*Primary Examiner*—Willis R. Wolfe, Jr.
*Assistant Examiner*—Johnny H. Hoang
(74) *Attorney, Agent, or Firm*—Nixon & Vanderhye PC

(57) ABSTRACT

The internal combustion engine control apparatus includes a calculation function of calculating an energy generation rate of an energy generated by combustion of fuel injected into a combustion chamber of a compression-ignition internal combustion engine, and an ignition detection function of detecting an ignition timing of the fuel in the combustion chamber on the basis of a timing at which the energy generation rate exceeds a first threshold value. When the energy generation rate due to a main injection, which is an object of ignition timing detection by the ignition detection function, exceeds the first threshold value at a plurality of timings, the ignition detection function determines an earliest one of the plurality of the timings as the ignition timing of the main injection.

8 Claims, 12 Drawing Sheets

INTERNAL COMBUSTION ENGINE CONTROL APPARATUS

CROSS-REFERENCE TO RELATED APPLICATION

This application is related to Japanese Patent Application No. 2006-205558 filed on Jul. 28, 2006, the contents of which are hereby incorporated by reference.

BACKGROUND OF THE INVENTION

1. Field of the Invention

The present invention relates to an internal combustion engine control apparatus capable of detecting an ignition timing in an compression-ignition internal combustion engine.

2. Description of Related Art

As such a control apparatus, there is a one that detects a pressure within a combustion chamber (in-cylinder pressure) by use of an in-cylinder sensor, and detects an ignition timing on the basis of the output value of the in-cylinder sensor. In this control apparatus, an energy generation rate (a heat generation rate) in the combustion chamber is calculated on the basis of the output of the in-cylinder sensor, and an ignition timing is detected on the basis of the calculated energy generation rate. A timing at which the heat generation rate (energy generation rate) exceeds a predetermined threshold value may be determined as the ignition timing.

However, the inventors of this application have found such a phenomenon that the heat generation rate re-increases after the heat generation rate increases and then decreases by fuel injection. This phenomenon can occur when there occurs a premixed combustion in a diesel engine, for example. In this case, the timing at which the heat generation rate exceeds the predetermined value cannot be determined as the ignition timing, because the heat generation rate exceeds the predetermined threshold value multiple times.

Japanese Patent Application Laid-open No. 2005-351161 discloses an internal combustion engine control apparatus as described above.

SUMMARY OF THE INVENTION

The present invention provides an internal combustion engine control apparatus comprising:

a calculation function of calculating an energy generation rate of an energy generated by combustion of fuel injected into a combustion chamber of a compression-ignition internal combustion engine; and an ignition detection function of detecting an ignition timing of the fuel in the combustion chamber on the basis of a timing at which the energy generation rate exceeds a first threshold value;

wherein, when the energy generation rate due to a main injection, which is an object of ignition timing detection by the ignition detection function, exceeds the first threshold value at a plurality of timings, the ignition detection function determines an earliest one of the plurality of the timings as the ignition timing of the main injection.

The present invention also provides an internal combustion engine control apparatus comprising:

an injection function of performing fuel injection by one time or a plurality of times within one combustion cycle into a combustion chamber of a compression-ignition internal combustion engine;

a calculation function of calculating an energy generation rate of an energy generated by combustion of fuel injected into the combustion chamber;

a peak detection function of detecting a peak timing at which the energy generation rate peaks;

a timing detection function of detecting a timing at which the energy generation rate exceeds a threshold value; and an ignition detection function of detecting an ignition timing of the fuel in the combustion chamber on the basis of the timing detected by the timing detection function;

wherein, when the timing detection function detects that the energy generation rate exceeds the threshold value at a plurality of timings, a value of the number of the plurality of the timings detected by the timing detection function subtracted by the number of injections within the one combustion cycle is positive, and the energy generation rate exceeds the threshold value at a plurality of timings due to one of a plurality of injections performed within the one combustion cycle by the injection function, a fuel injection amount which is larger than any of fuel injection amounts by the other of the plurality of the injections, the ignition detection function detects, as the ignition timing, one of the plurality of the timings detected by the timing detection function, which is earlier, by the value, than one of the plurality of the timings detected by the timing detection function which is closest to the peak timing.

The present invention also provides an internal combustion engine control apparatus comprising:

an injection function of performing fuel injection by one time or a plurality of times within one combustion cycle into a combustion chamber of a compression-ignition internal combustion engine;

a calculation function of calculating an energy generation rate of an energy generated by combustion of fuel injected into the combustion chamber;

a timing detection function of detecting a timing at which the energy generation rate exceeds a threshold value; and an ignition detection function of detecting an ignition timing of the fuel injected into the combustion chamber on the basis of the timing detected by the timing detection function;

wherein, when a value of the number of timings detected by the timing detection function subtracted by the number of injections within the one combustion cycle is positive, the ignition detection function identifies an injection due to which the energy generation rate exceeds the threshold value at a plurality of timings in order to detect the ignition timing.

According to the present invention, it becomes possible to correctly detect the ignition timing of compression-ignition internal combustion engine even in a case where the energy generation rate repeats due to a fuel injection repeats rising and falling Other advantages and features of the invention will become apparent from the following description including the drawings and claims.

PREFERRED EMBODIMENTS OF THE INVENTION

Figure 1:
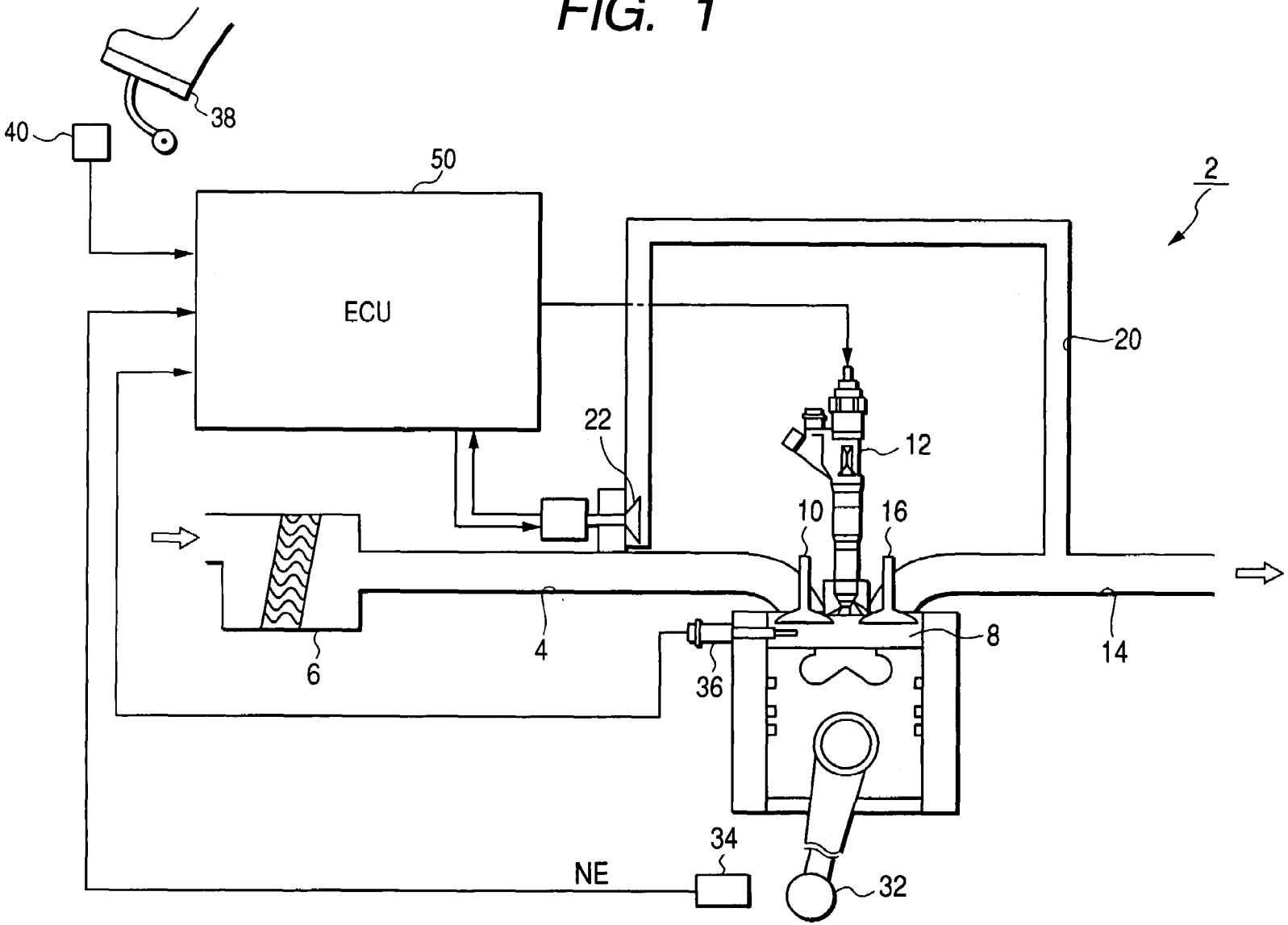
FIG. 1 is a diagram showing a diesel engine system provided with an internal combustion engine control apparatus according to a first embodiment of the invention.

FIG. 1 is a diagram showing a diesel engine system provided with an internal combustion engine control apparatus according to a first embodiment of the invention.

As shown in this figure, in this diesel engine system, an air cleaner 6 is provided upstream of an intake passage 4 of a diesel engine 2. The intake passage 4 and a combustion chamber 8 of the diesel engine 2 are communicated with each other when an intake valve 10 is opened. The combustion chamber 8 is provided with a fuel injection valve 12 mounted thereto so as to jut out of the combustion chamber 8. The combustion chamber 8 and an exhaust passage 14 are communicated with each other when an exhaust valve 16 is opened. The exhaust passage 14 and the intake passage 4 are in communication with each other through an exhaust return passage 20. The exhaust return passage 20 is provided with an EGR valve 22 at a portion thereof for connection with the intake passage 4. The EGR valve 22 operates to regulate a flow passage area of the exhaust return passage 20. The EGR valve 22 incorporates a sensor outputting a signal representing an opening degree of the EGR valve 20.

This engine system includes a crank sensor 34 detecting a rotational speed of a crank shaft 32 of the diesel engine 2, an in-cylinder sensor 36 detecting a pressure within the combustion chamber 8, and an accelerator sensor 40 detecting a depression depth of an accelerator pedal 38.

An electronic control unit (ECU) 50 of this engine system manipulates various actuators including the fuel injection valve 12, and the EGR valve 22 on the basis of the outputs of the above described various sensors in order to control the output characteristics (output torque, exhaust characteristic, vibration, etc.) of the diesel engine 2.

Next, explanation is given as to a fuel injection control which the ECU 50 performs to keep the output characteristics of the diesel engine 20 in a good condition. In this fuel injection control, a required injection amount corresponding to a required torque is calculated on the basis of the depression depth of the accelerator 38 detected by the accelerator sensor 40, and the rotational speed of the crank shaft 32 detected by the crank sensor 34. The calculated required injection amount is divided into a plurality of subamounts in order to perform a multi-stage injection control where fuel is injected multiple times during one combustion cycle. In more detail, some of a pilot injection, a pre-injection, a main injection, and an after-injection are selected, and the required injection amount is assigned to the selected injections. The pilot injection is for promoting mixing between atomized fuel and air immediately before ignition. The pre-injection is for reducing delay of an ignition timing after the main injection, to thereby suppress generation of NOx, combustion sound, and vibration. The main injection, the injection amount of which is largest among these injections, is for generating a substantial output torque of the diesel engine. The after-injection is for reburning PM (particulate matter).

When fuel is injected from the fuel injection valve 12 into the combustion chamber 8, it self-ignites in the combustion chamber 8. The timing at which combustion starts by the self-ignition affects the output characteristics of the diesel engine 2. Especially, the timing of the self-ignition in the main injection dominantly affects the output characteristics of the diesel engine 2. Accordingly, this embodiment performs a feedback control where the ignition timing of the main injection is detected, and a fuel injection timing is adjusted in accordance with the detected ignition timing.

Figure 2:
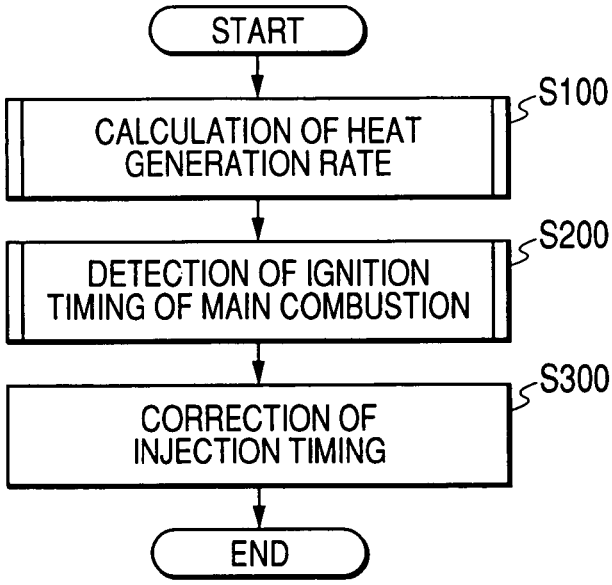
FIG. 2 is a flowchart showing procedures of a fuel injection control performed in the first embodiment of the invention.

FIG. 2 is a flowchart showing procedures of the feedback control performed periodically by the ECU 50 for controlling the ignition timing of the main injection.

As shown in FIG. 2, this feedback control begins by calculating at step S100 the heat generation rate, that is, the amount of heat generated per unit time within the combustion chamber 8 by the multi-stage injection on the basis of the output of the in-cylinder sensor 36. At subsequent step S200, an ignition timing of the main injection (main combustion ignition timing) is detected on the basis of the calculated heat generation rate. At final step S300, timings of the main fuel injection and other injections are corrected to control the ignition timing of the main injection as desired.

Figure 3:
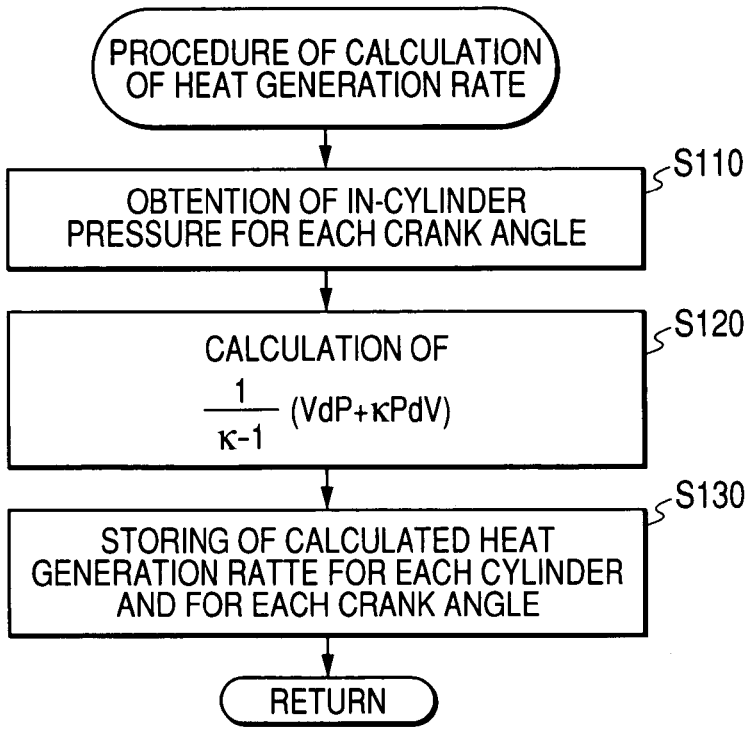
FIG. 3 is a flowchart showing processes of a heat generation rate calculating procedure performed in the first embodiment of the invention.

FIG. 3 is a flowchart showing processes of the heat generation calculating procedure at step S100.

As shown in FIG. 3, the heat generation calculating procedure begins by obtaining at step S110 a pressure P within the combustion chamber 8 detected by the in-cylinder sensor 36 for each of specified crank angles for each cylinder. At subsequent S120, a computation of the following equation is performed to calculate the heat generation rate.

$$(VdP+\kappa PdV)/\kappa-1$$

In this equation, P represents the pressure within the combustion, chamber 8, V represents a volume of the combustion chamber 8, and κ represents a specific heat ratio. At final step S130, the calculated heat generation rate is memorized for each specified crank angle and each cylinder.

Figure 4:
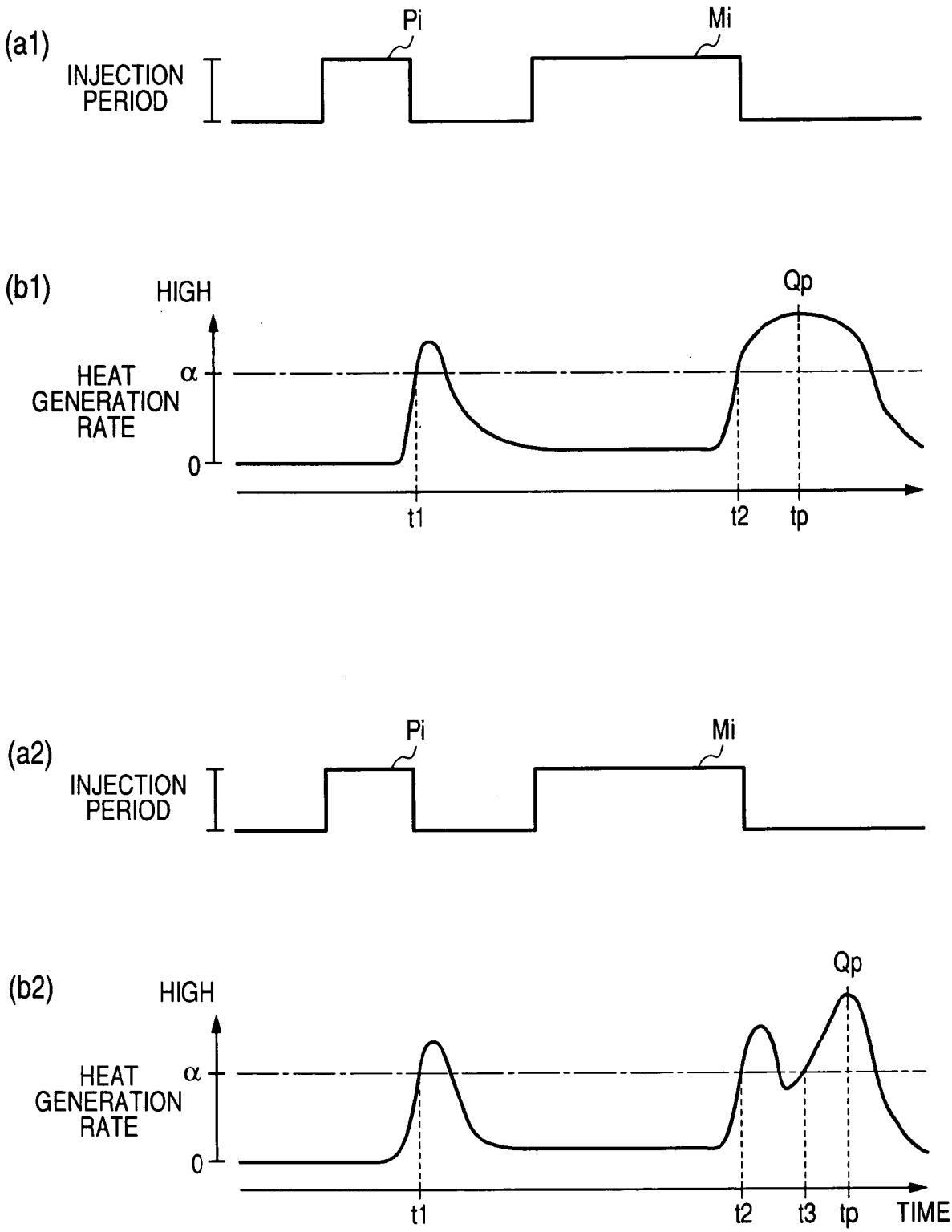
FIG. 4 is a time chart showing an example of change of the heat generation rate with time due to fuel injection.

FIG. 4 is a time chart showing examples of change with time of the heat generation rate with fuel injection in a case where the pilot injection and the main injection are performed under the multi-stage injection control. In these examples, the periods during which the pilot injection Pi and the main injection Mi are performed are as shown in (a1) and (a2) of FIG. 4, and the heat generation rate changes with time as shown in (b1) or (b2) of FIG. 4.

As shown in FIG. 4, the heat generation rate increases following the pilot injection Pi, and decreases after a while.

Likewise, the heat generation rate increases following the main injection Mi, and decreases after a while. In the case shown in (b1) of FIG. 4, timings t1 and t2 at each of which the heat generation rate exceeds a predetermined threshold value α shown by the chain line in this figure roughly coincide with an ignition timing of the pilot injection Pi and an ignition timing of the main injection Mi, respectively. The heat generation rate takes its peak value Qp at a peak timing tp due to heat generated by the main injection Mi, because the fuel injection amount and the fuel injection rate in the main injection are far larger than those in other injections during the multi-stage injection. Accordingly, of the timing t1 and the timing t2, the one closer to the peak timing tp can be determined as the ignition timing of the main injection.

However, in the case shown in (b2) of FIG. 4, the heat generation rate with the main injection re-increases after it increases and then decreases. Such a phenomenon is caused by a premixed combustion or the like. In this case, the heat generation rate exceeds the threshold value α at the timing t1 corresponding to the ignition timing of the pilot injection, at the timing t2 corresponding to the ignition timing of the main injection, and also at the timing t3 at which the heat generation rate re-increases. Of these three timings, the timing t3 is closest to the peak timing tp. Therefore, if the one closest to the peak timing tp of these timings at each of which the heat generation rate exceeds the threshold value α is determined as the ignition timing of the main injection, it is not possible to accurately detect the ignition timing.

Accordingly, in this embodiment, if the heat generation rate with the main injection exceeds the threshold value α at multiple timings, the earliest one of these timings is determined as the ignition timing of the main injection. This is explained in detail below with reference to the flowchart of FIG. 5 showing processes of the procedure for detecting a main combustion ignition timing at step S200 shown in FIG. 2.

Figure 5:
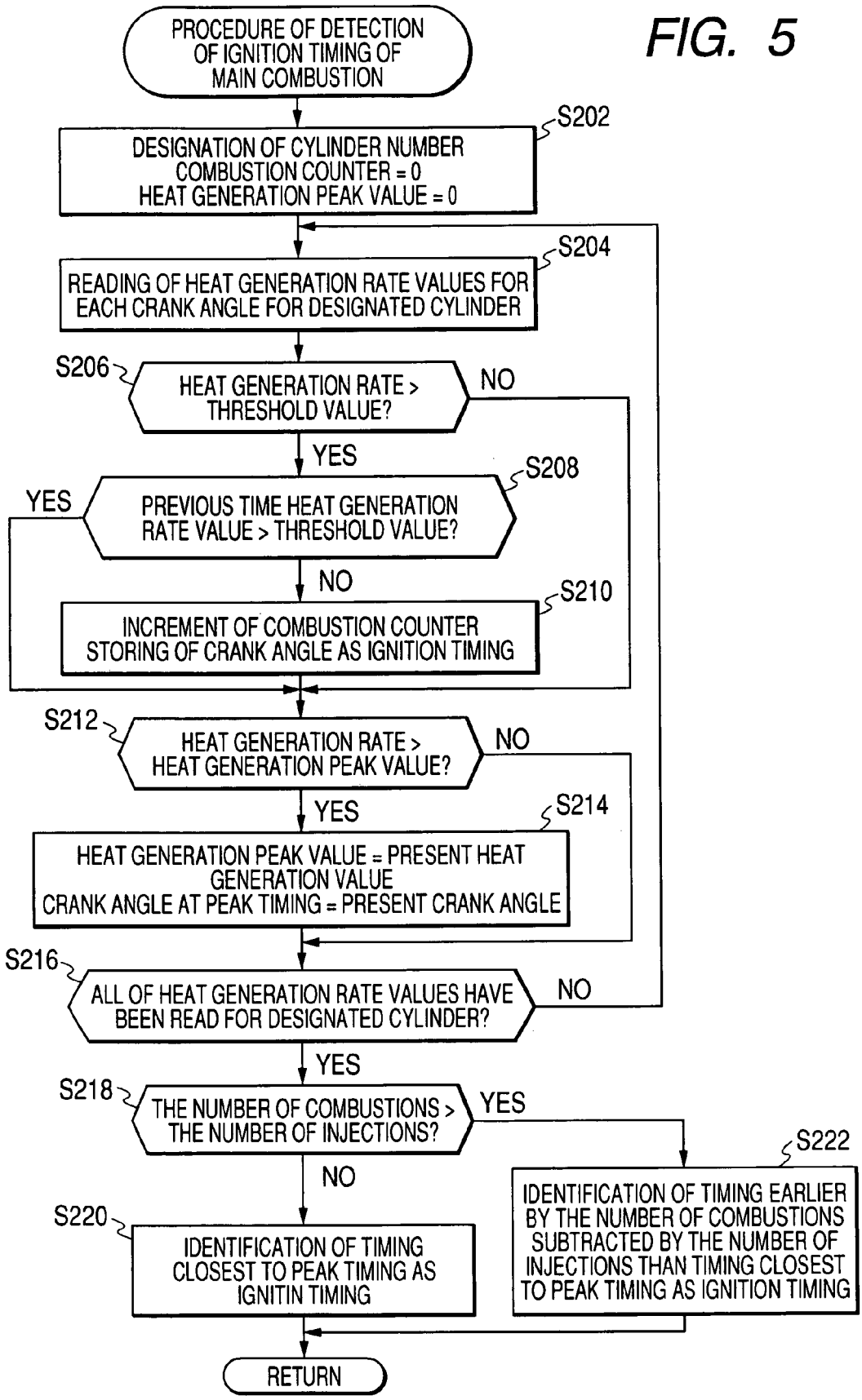
FIG. 5 is a flowchart showing processes of a procedure for detecting an ignition timing of a main injection performed in the first embodiment of the invention.

As shown in FIG. 5, this procedure begins by designating a cylinder number of a cylinder to be subjected to this procedure, and resetting a count value of a combustion counter and a heat generation peak value at step S202. The combustion counter is for counting the number of times that the heat generation rate exceeds the threshold value α. The heat generation peak value carries a peak of the heat generation rate in one combustion cycle.

At step S204, the values of the heat generation rate calculated by the procedure shown in FIG. 3 are read one by one in the order from the advanced angle side for the designated cylinder. Next, it is judged at step S 206 whether or not the heat generation rate value read at step S204 is larger than the threshold value α. If the judgment at step S 206 is affirmative (YES), then the procedure proceeds to step S208 where it is judged whether or not the heat generation rate value read previous time is larger than the threshold value α. These steps S206 and S208 are for detecting a timing at which the heat generation rate exceeds the threshold value α. If the heat generation rate value read previous time is smaller than the threshold value α, and the heat generation rate value read this time is larger than the threshold value α, a sampling timing (crank angle) at which the heat generation rate reached the value that has been read this time can be determined as the timing at which the heat generation rate exceeds the threshold value α.

If the judgment at step S 208 is negative (NO), then the procedure proceeds to step S210 where the count value of the combustion counter is incremented by one, and the sampling timing (crank angle) of the heat generation value read this time at step S204 is stored.

If the judgment at step S206 is negative, or the judgment at step S208 is affirmative, or when step S210 is completed, the procedure proceeds to step S212. At step S212, it is judged whether or not the heat generation value read this time is larger than the heat generation peak value. If the judgment at step S212 is affirmative, the procedure proceeds to step S214 where the heat generation peak value is updated by the heat generation rate value read this time, and the sampling timing (crank angle) of this time heat generation rate value is stored while being associated with the heat generation peak value.

If the judgment at step S212 is negative, or when step S214 is completed, the procedure proceeds to step S216 where it is judged whether or not all the heat generation rate values have been read for the designated cylinder. If the judgment at step S216 is negative, the procedure returns to step S204.

If the judgment at step S216 is affirmative, the procedure proceeds to step S218 where it is checked whether or not the count value of the combustion counter is larger than the number of injections in order to judge whether or not the heat generation rate with the main injection has exceeded the threshold value α multiple times. If the check result at step S218 is negative, the procedure proceeds to step S220 where, of a plurality of the timings at each of which the heat generation rate exceeded the threshold value α, the one closest to the timing of the heat generation peak value is determined as the ignition timing. On the other hand, if the check result at step S218 is affirmative, that is, if it is judged that the heat generation rate with the main injection has exceeded the threshold value α a multiple times, the procedure proceeds to step S222. At step S222, of the timings at each of which the heat generation exceeds the threshold value α, the one whose chronological order number is earlier, by a value equal to the number of combustions subtracted by the number of injections, than that of the timing which is earlier than and closest to the timing of the heat generation peak value is determined as the ignition timing of the main injection.

Be performing steps S218 to S222, the timing t2 is detected as the ignition timing of the main injection in the case shown in (b1) of FIG. 4, and also in the case shown in (b2) of FIG. 4.

This embodiment of the invention offers the following advantages.

(1) In the case where the heat generation rate with the main injection exceeds the threshold value α at multiple timings, the earliest one of these is determined as the ignition timing of the main injection. This makes it possible to correctly detect the ignition timing even when the heat generation rate with the main injection repeats rising and falling.

(2) In the case where the value of the number of timings at each of which the heat generation rate exceeds the threshold value α subtracted by the number of injections is positive, the one of these timings that is earlier than the timing closest to the timing of the heat generation peak value by this positive value is determined as the ignition timing of the main injection. This makes it possible to correctly detect the ignition timing of the main injection.

(3) The self-ignition timing of the diesel engine is corrected in accordance with the detected ignition timing. This makes it possible to cause the injected fuel to self-ignite at a desired timing in order to well control the output characteristics of the diesel engine 2.

Second Embodiment

A second embodiment of the invention is described below. The below explanation focuses on the difference between the second embodiment and the first embodiment.

Figure 6:
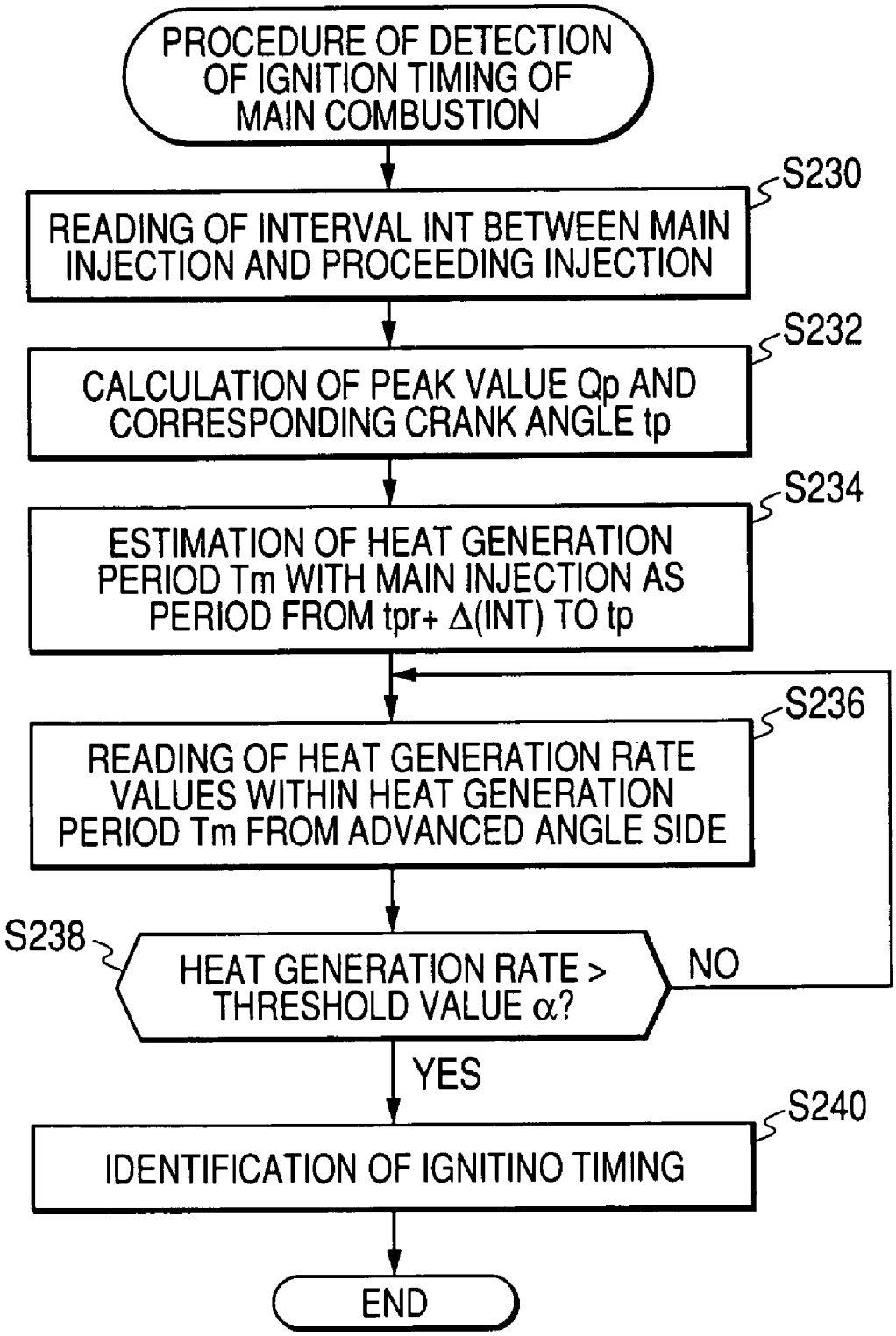
FIG. 6 is a flowchart showing processes of a procedure for detecting an ignition timing of a main injection performed in a second embodiment of the invention.

In the second embodiment, a heat generation period with the main injection is estimated, and a timing at which the heat generation rate first exceeds the threshold value α within the estimated heat generation period is determined as the ignition timing of the main injection. FIG. 6 is a flowchart showing processes of a procedure for detecting the ignition timing of the main injection (main combustion) in the second embodiment, this procedure corresponding to the procedure of step S200 shown in FIG. 2 performed in the first embodiment.

This procedure begins by reading an interval INT between the main injection and the injection which precedes this main injection. This interval INT may be stored while being associated with the detection value by the in-cylinder sensor 36 at the time of performing the multi-stage injection control, and may be restored while being associated with the calculated heat generation rate at step S100 shown in FIG. 2. At subsequent step S232, the peak value Qp of the heat generation rate with the multi-stage injection is calculated together with its timing (crank angle). This process may be performed by a procedure similar to the procedure shown in FIG. 5.

Next, a heat generation period Tm with the main injection is estimated at step S234. In this embodiment, the heat generation period Tm is estimated to be a period from when a delay time Δ (INT) has elapsed after the injection preceding the main injection is completed at the timing tpr until the heat generation rate takes its peak value Qp. The delay time Δ (INT) is a function of the interval INT.

After that, at step S236, the values of the heat generation rate calculated by the procedure shown in FIG. 3 are read one by one in the order from the advanced angle side for the designated cylinder. Next, it is judged at step S 238 whether or not the heat generation rate value read at step S236 is larger than the threshold value α. The step S238 is for detecting a timing at which the heat generation rate exceeds the threshold value α. If the judgment at step S238 is negative, the procedure returns to step S236. If the judgment at step S238 is affirmative, the procedure proceeds to step S240 where a sampling timing at which the heat generation rate reached the value that has been read this time is determined as the ignition timing.

Figure 7:
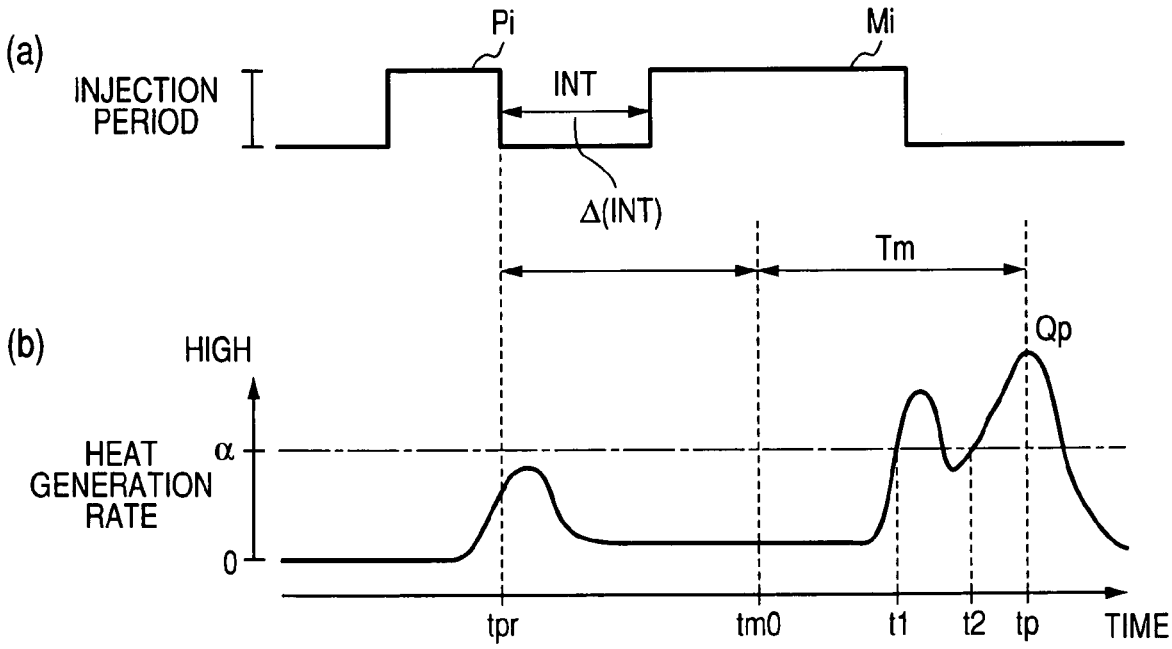
FIG. 7 is a time chart for explaining an example of detecting the ignition timing of the main injection in the second embodiment of the invention.

FIG. 7 is a time chart for explaining an example of detecting the ignition timing in this embodiment. In this example, the periods during which the pilot injection Pi and the main injection Mi are performed are as shown in (a) of FIG. 7, and the heat generation rate changes with time as shown in (b) of FIG. 7. As shown in this figure, the heat generation period Tm is estimated to be a period from the timing tm0 when the delay time Δ (INT) has elapsed after the pilot injection Pi preceding the main injection Mi is completed at the timing tpr to the timing tp at which the heat generation rate takes its peak value Qp. And a timing t1 at which the heat generation rate first exceeds the threshold value α within this heat generation period Tm is determined as the ignition timing of the main injection. This makes it possible to prevent the timing t2 at which the heat generation rate re-exceeds the threshold value α from being erroneously detected as the ignition timing in the case where the heat generation rate with the main injection repeats rising and falling.

The second embodiment offers the following advantage in addition to the advantages (1) and (3) offered by the first embodiment.

(4) The heat generation period with the main injection is estimated in accordance with at least one of the running state of the diesel engine 2 and the calculated heat generation rate. This makes it possible to distinguish the values of the heat generation rate with the main injection from other values of the heat generation rate with other injections.

Third Embodiment

A third embodiment of the invention is described below. The below explanation focuses on the difference between the third embodiment and the second embodiment.

Figure 8:
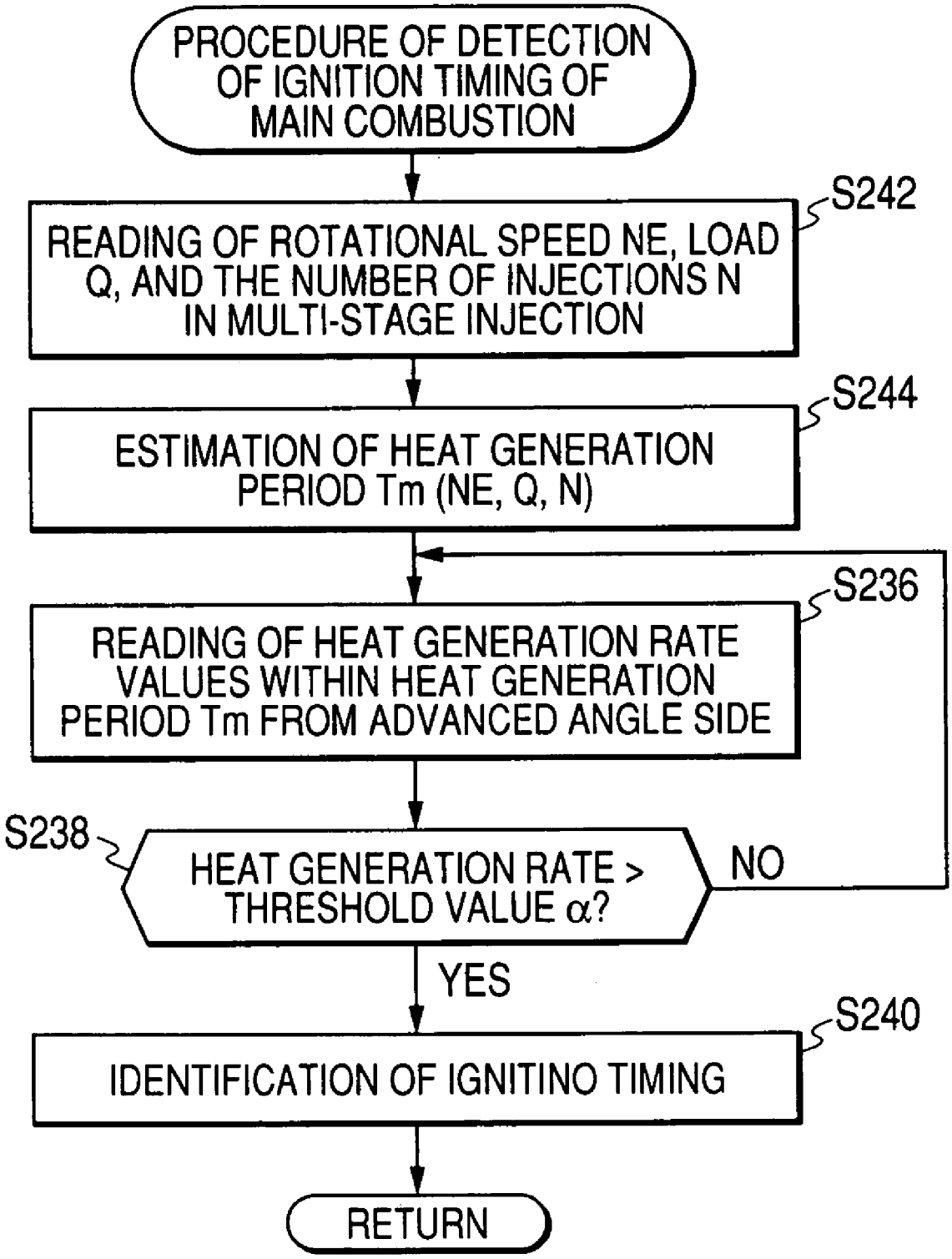
FIG. 8 is a flowchart showing processes of a procedure for detecting an ignition timing of a main injection performed in a third embodiment of the invention.

FIG. 8 is a flowchart showing processes of a procedure for detecting the ignition timing in the third embodiment, this procedure corresponding to the procedure of step S200 shown in FIG. 2 performed in the first embodiment. In FIG. 8, the steps that are identical to those shown in FIG. 6 are given the same step numbers as in FIG. 6.

As shown in FIG. 8, this procedure begins by reading a rotational speed, a load, and the number of injections for a designated cylinder at step S242. The load may be a required injection amount. These three parameters may be stored while being associated with the detection value by the in-cylinder sensor 36 at the time of performing the multi-stage injection control, and may be restored while being associated with the calculated heat generation rate at step S100 shown in FIG. 2.

Next, at step S244, a heat generation period Tm with the main injection is estimated on the basis of the rotational speed, load, and number of injections read at step S242. The period of the main injection can be roughly determined from the rotational speed, the load, and the number of injections, and the heat generation period with the main injection can be estimated from the period of the main injection. Accordingly, in this embodiment, these three parameters are used to estimate the heat generation period with the main injection.

After completion of step S244, steps S236 to S240 are performed.

Figure 9:
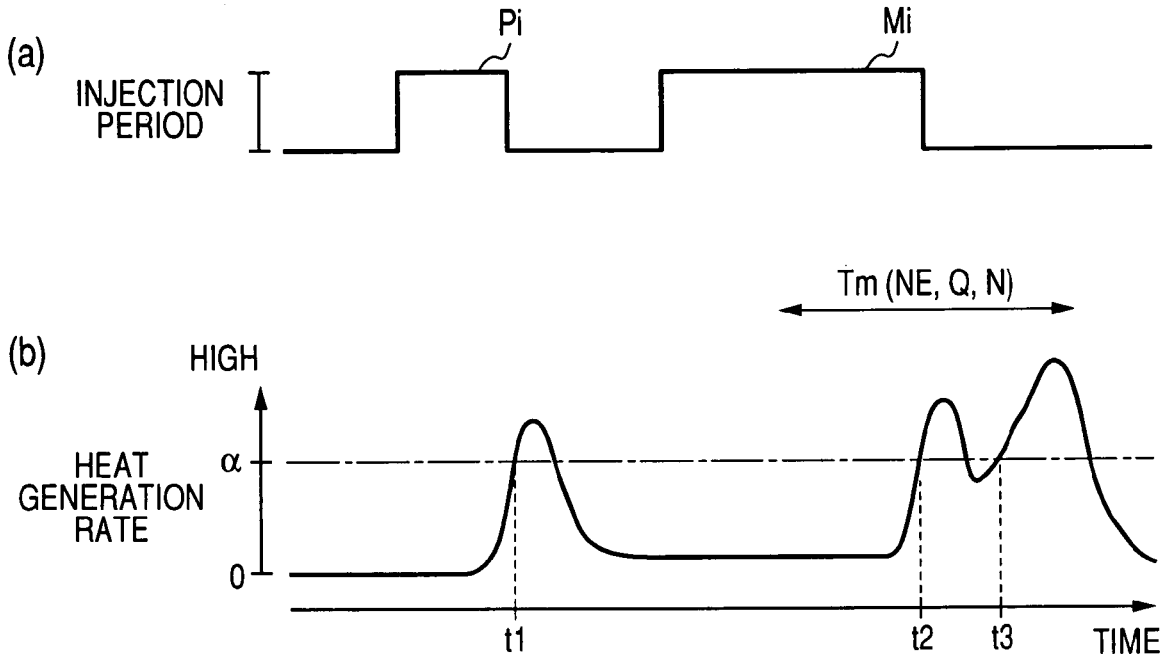
FIG. 9 is a time chart for explaining an example of detecting the ignition timing of the main injection in the third embodiment of the invention.

FIG. 9 is a time chart explaining an example of detecting the ignition timing in this embodiment. In this example, the periods during which the pilot injection Pi and the main injection Mi are performed are as shown in (a) of FIG. 9, and the heat generation rate changes with time as shown in (b) of FIG. 9. The heat generation period Tm with the main injection Mi is estimated on the basis of the rotational speed NE, the load Q, and the number of injections N. In the third embodiment, a timing at which the heat generation rate first exceeds the threshold value α within this period Tm is determined as the ignition timing of the main injection. This makes it possible to prevent the timing t1 at which the heat generation rate exceeds the threshold value α due to the pilot injection Pi, and the timing t3 at which the heat generation rate repeating rising and falling re-exceeds the threshold value α from being erroneously detected as the ignition timing of the main injection Mi.

The third embodiment offers the following advantage in addition to the advantages (1) and (3) offered by the first embodiment, and the advantage (4) offered by the second embodiment.

(5) The heat generation period of the main injection is estimated in accordance with the rotational speed, the load and the number of injections. This makes it possible to properly estimate the heat generation period Tm.

Fourth Embodiment

A fourth embodiment of the invention is described below. The below explanation focuses on the difference between the fourth embodiment and the second embodiment.

Figure 10:
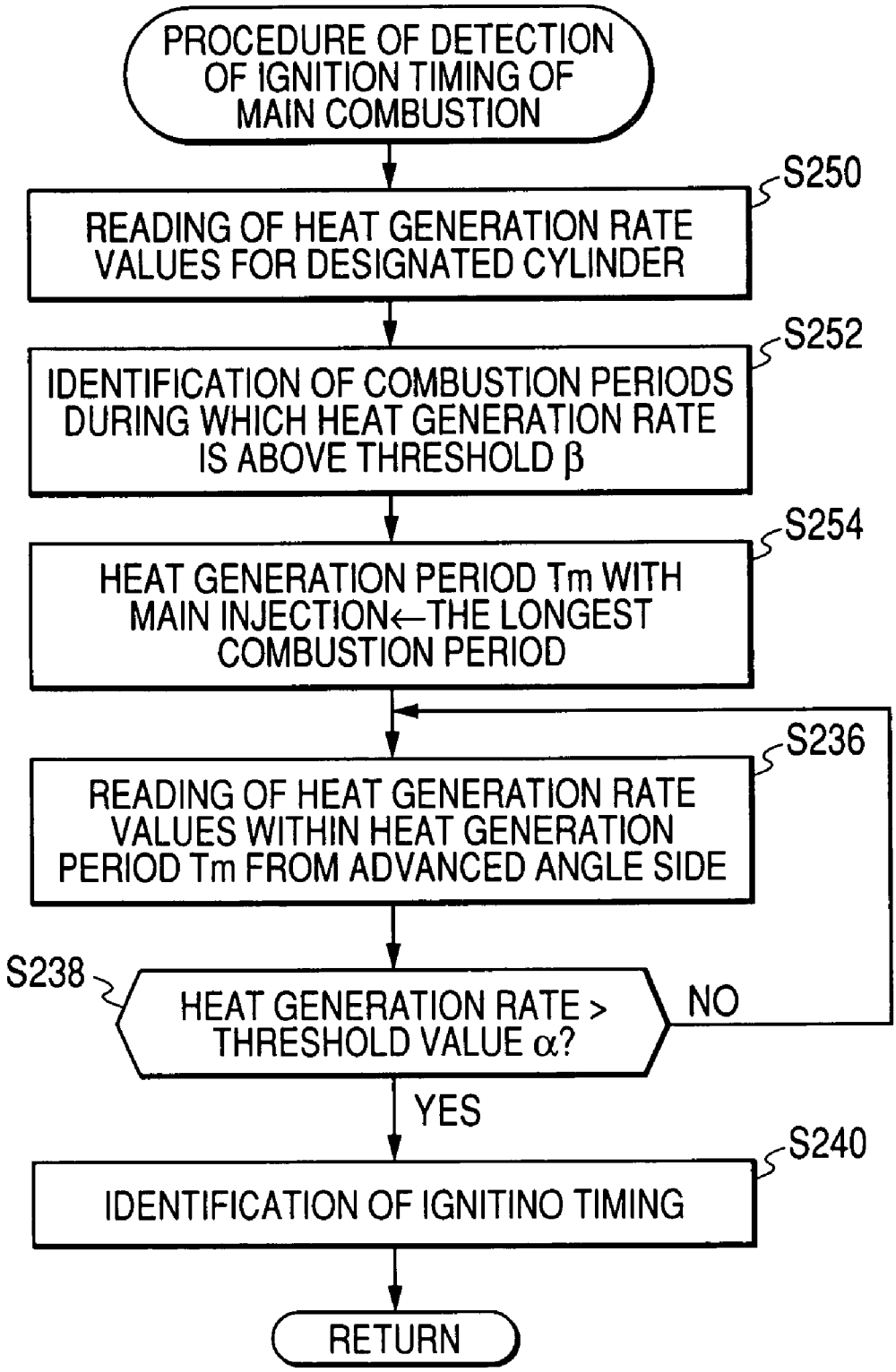
FIG. 10 is a flowchart showing processes of a procedure for detecting an ignition timing of a main injection performed in a fourth embodiment of the invention.

FIG. 10 is a flowchart showing processes of a procedure for detecting the ignition timing in the fourth embodiment, this procedure corresponding to the procedure of step S200 shown in FIG. 2 performed in the first embodiment. In FIG. 10, the steps that are identical to those shown in FIG. 6 are given the same step numbers as in FIG. 6.

This procedure begins by reading the values of the heat generation rate calculated by the procedure shown in FIG. 3 for the designated cylinder at step S250. At subsequent step S252, a period during which the heat generation rate is smaller than the threshold value α and larger than another predetermined threshold value β that is smaller than the threshold value α is detected as a combustion period. When there are a plurality of such periods, the longest one of them is determined as the combustion period of the main ignition. Because, fuel is injected by the largest amount in the main injection during the multi-stage injection, and accordingly the longest one of them is due to the main injection. Next, at step S254, the heat generation period Tm with the main injection is estimated on the basis of the determined combustion period.

After the heat generation period Tm with the main injection is estimated, steps S236 to S240 are performed.

Figure 11:
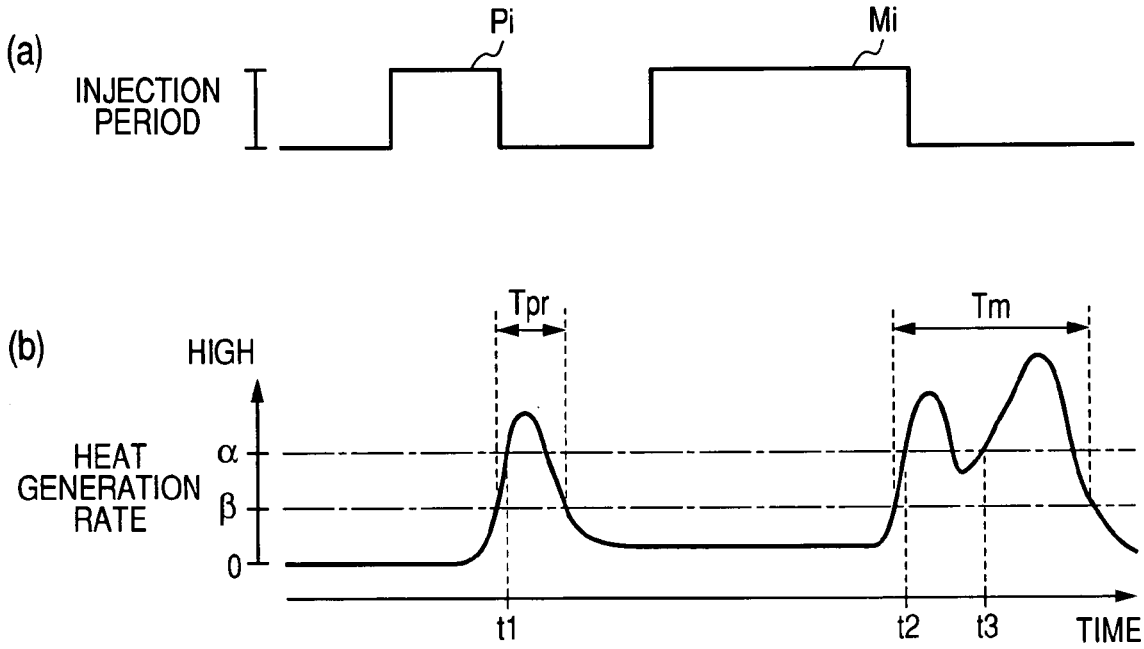
FIG. 11 is a time chart for explaining an example of detecting the ignition timing of the main injection in the fourth embodiment of the invention.

FIG. 11 is a time chart for explaining an example of detecting the ignition timing in this embodiment. In this example, the periods during which the pilot injection Pi and the main injection Mi are performed are as shown in (a) of FIG. 11, and the heat generation rate changes with time as shown in (b) of FIG. 11. As explained above, in this embodiment, the periods Tpr and Tm during each of which the heat generation rate is above the threshold value β which is smaller than the threshold value α are detected. The longer one of these periods, that is, the period Tm is determined as the heat generation period with the main injection Mi. And the timing t2 at which the heat generation rate first exceeds the threshold value α within the heat generation period Tm is detected as the ignition timing of the main injection Mi.

The fourth embodiment offers the following advantage in addition to the advantages (1), (3) offered by the first embodiment, and (4) offered by the second embodiment.

(6) Of the periods during each of which the energy (heat) generation rate is above the threshold value β, the longest one is determined as the heat generation period Tm with the main injection. This makes it possible to properly estimate the heat generation period Tm with the main injection.

Fifth Embodiment

A fifth embodiment of the invention is described below. The below explanation focuses on the difference between the fifth embodiment and the first embodiment.

Figure 12:
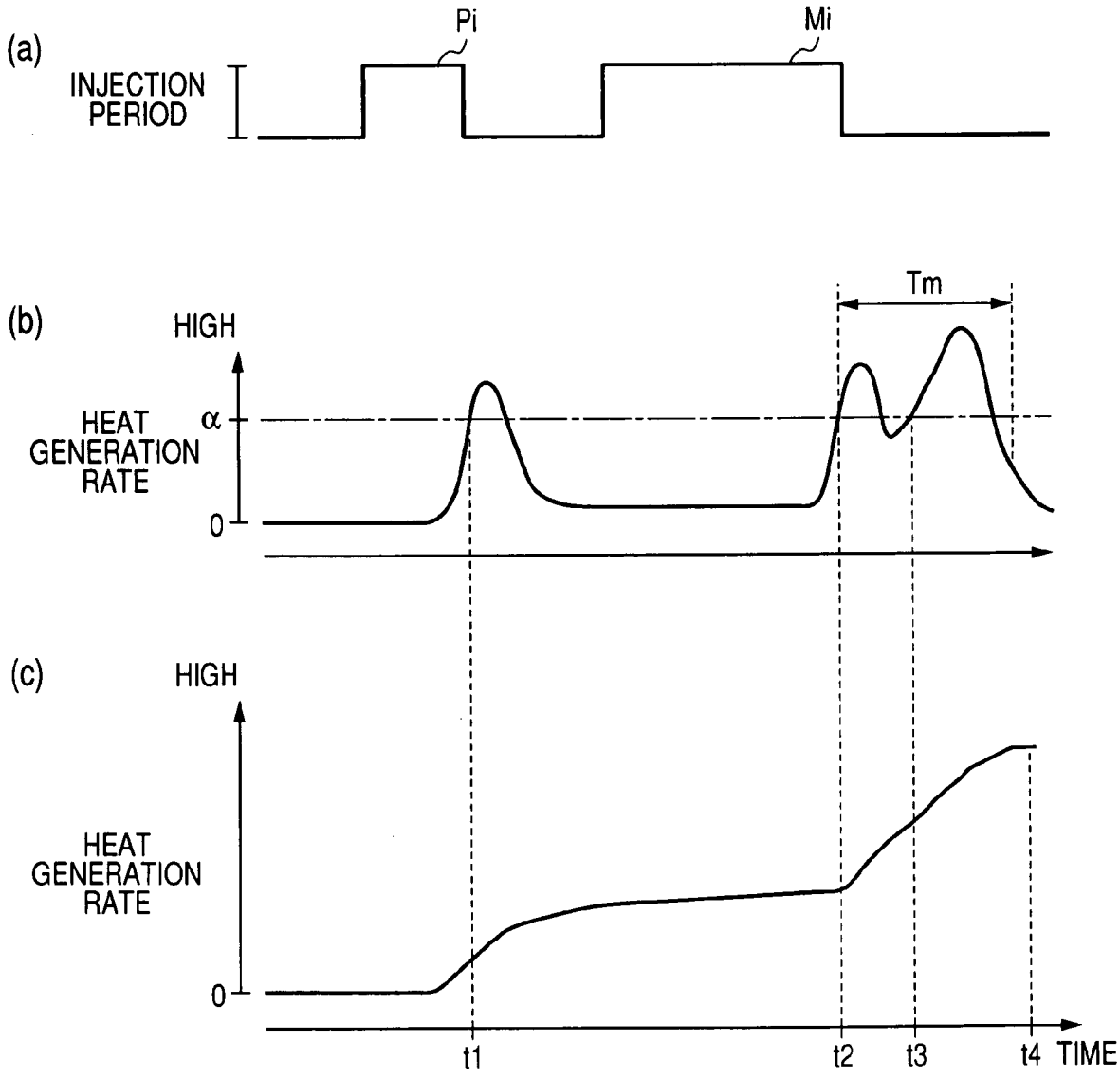
FIG. 12 is a time chart for explaining an example of detecting the ignition timing of a main injection in a fifth embodiment of the invention.

FIG. 12 is a time chart for explaining an example of detecting the ignition timing in this embodiment. In this example, the periods during which the pilot injection Pi and the main injection Mi are performed are as shown in (a) of FIG. 12, the heat generation rate changes with time as shown in (b) of FIG. 11, and the integrated value of the heat generation rate, that is, the accumulated amount of the generated heat in the multi-stage injection changes with time as shown in (c) of FIG. 12.

In this embodiment, a period around the timing at which the integrated value of the heat generation rate peaks is detected as the heat generation period with the main injection. As seen from FIG. 12, any timing close to the timing t4 at which the integrated value peaks, and at which the heat generation rate is above the threshold value α can be a candidate for the ignition timing of the main injection. As in the first embodiment, in the case where the number of timings at each of which the heat generation rate exceeds the threshold value α subtracted by the number of injections is positive, one of these timings which is earlier than the timing t4 of the heat generation peak value by this positive value is determined as the ignition timing of the main injection. Thus, the timing t2 is detected as the ignition timing of the main injection Mi.

The fifth embodiment offers the following advantage in addition to the advantages (1), (3) offered by the first embodiment, and (4) offered by the second embodiment.

(7) The heat generation period is estimated on the basis of the integrated value of the heat generation rate.

This makes it possible to properly estimate the heat generation period Tm with the main injection.

Sixth Embodiment

Figure 13:
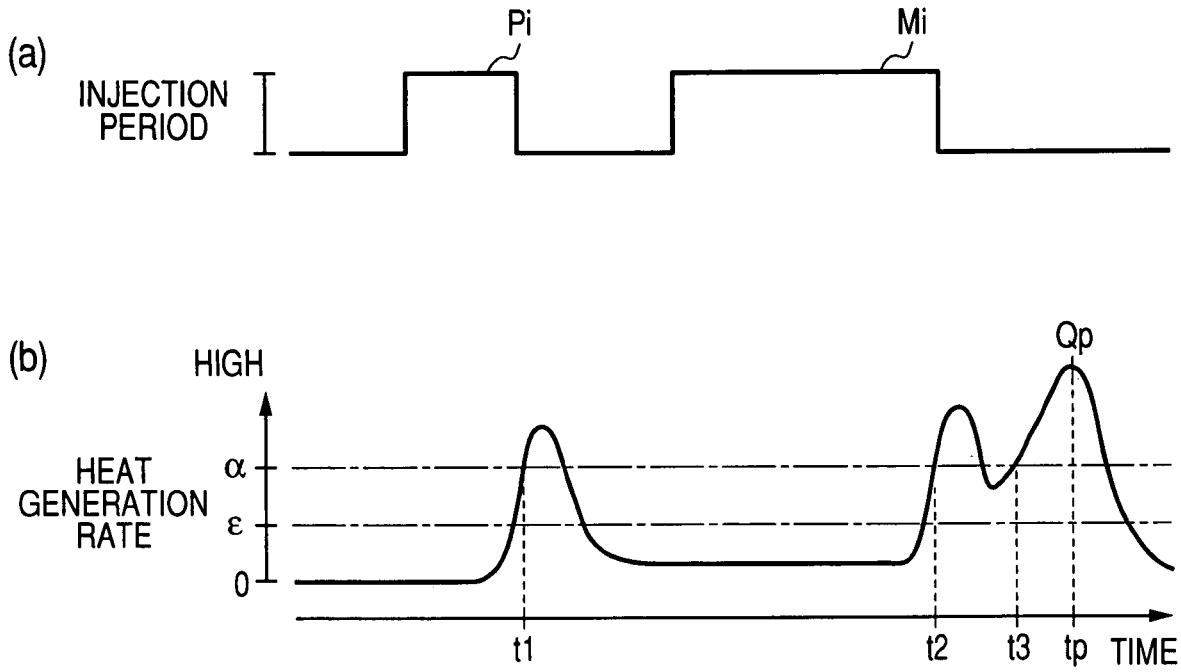
FIG. 13 is a time chart for explaining an example of detecting the ignition timing of a main injection in a sixth embodiment of the invention.

A sixth embodiment of the invention is described below. The below explanation focuses on the difference between the sixth embodiment and the first embodiment. FIG. 13 is a time chart for explaining an example of detecting the ignition timing in this embodiment. In this example, the periods during which the pilot injection Pi and the main injection Mi are performed are as shown in (a) of FIG. 13, and the heat generation rate changes with time as shown in (b) of FIG. 13.

In this embodiment, of the timing t1 and the timing t2 at each of which the heat generation rate rises from below a predetermined threshold value ϵ smaller than the threshold value α to beyond the threshold value α, the one closer to the timing tp at which the heat generation rate peaks is detected as the ignition timing of the main injection Mi. The threshold value ϵ is set to a value which the heat generation rate is estimated not to fall below when it repeats rising and falling in one injection. As seen from this figure, this makes it possible to eliminate the timing t3 at which the heat generation rate repeating rising and falling re-exceeds the threshold value α from candidates of the ignition timing. In this example shown in FIG. 13, although the heat generation rate exceeds the threshold value α at three timings, the heat generation rate rises from below the threshold value ϵ beyond the threshold value α at two timings, that is, at the timing t1 and the timing t2. And the timing t2 closer to the timing of the peak value Qp can be determined as the ignition timing of the main injection, for the reason that the peak value Qp of the heat generation rate is due to the heat generated with the main injection.

The sixth embodiment offers the following advantage in addition to the advantages (1), (3) offered by the first embodiment, and (4) offered by the second embodiment.

(8) The timing at which the heat generation rate rises from below the threshold value ϵ beyond the threshold value α, and which is closest to the timing of the peak value Qp is detected as the ignition timing of the main injection.

This makes it possible to correctly detect the ignition timing.

Other Embodiments

It is a matter of course that various modifications can be made to the above described embodiments as set forth below.

In the first embodiment, if the heat generation rate with an injection other than the main injection exceeds the threshold value at multiple timings, the ignition timing of the main injection cannot be correctly detected by the procedure shown in FIG. 5. To cope with this, there may be provided a step for judging whether or not the multiple timings at which the heat generation rate exceeds the threshold value are due to the main injection when the judgment at step S218 is affirmative. This step may be such as to make the judgment on the basis of the estimation of the heat generation period with the main injection. In the first embodiment, if the heat generation rate with an injection other than the main injection does not reach the threshold value, the ignition timing of the main injection cannot be correctly detected by the procedure shown in FIG. 5. To cope with this, there may be provided a first step for judging whether or not the heat generation rate reaches the threshold value for all the injections by estimating a heat generation period for each injection, a second step for judging whether or not the number of combustions is larger than the total number of injections subtracted by the number of injections by which the heat generation rate do not reach the threshold value, and a third step for determining, of the timings at each of which the heat generation exceeds the threshold value, the one whose chronological order number is earlier, by a value equal to the number of combustions subtracted by the total number of injections having been subtracted by the number of injections by which the heat generation rate does not reach the threshold value, than that of the timing which is earlier than and closest to the timing of the heat generation peak value as the ignition timing of the main injection. The second step is performed instead of step S218, and the third step is performed instead of step S222, if the judgment at the first step is negative.

In the fifth embodiment, when an after-injection is performed, the integrated value of the heat generation rate peaks after completion of the after-injection. Accordingly, in this case, it is preferable to detect a timing of end of the main injection which precedes a period during which the integrated value increases lastly due to the after-injection.

The way to estimate the heat generation period with the main injection is not limited to the one described above. For example, a period between a start timing designated by a main injection start command and an end timing designated by an injection period command may be determined as the heat generation period with the main injection.

The way to detect the timing at which the heat generation rate exceeds the threshold value $\alpha$ is not limited to the one described above. For example, it is possible that only when the heat generation rate is above the threshold value $\alpha$ for a period longer than a predetermined time, the start timing of this period is detected as the timing at which the heat generation exceeds the threshold value $\alpha$. This configuration makes it possible to avoid misdetection due to noise.

In the above described embodiments, the fuel injection timing is corrected on the basis of the detection result of the ignition timing of the main injection, however, instead, the opening degree of the EGR valve 22 may be corrected on the basis of the detection result of the ignition timing of the main injection. The point is that the output characteristics of the diesel engine can be controlled as desired by manipulating an actuator used for control of the output of the diesel engine on the basis of the detection result of the ignition timing of the main injection.

The above described embodiments are configured to detect the ignition timing of the main injection. However, they may be configured to detect the ignition timing of an injection other than the main injection. When the heat generation rate exceeds the threshold value at multiple timings in one injection, detecting the earliest one of these timings may be of importance even for injections other than the main injection. For example, in a case where it is required to detect the ignition timing of an injection preceding the main injection, if the heat generation rate with this injection exceeds the threshold value at multiple timings, the earliest one of these timings can be detected as the ignition timing of this injection.

The way to quantify the energy generation rate in the combustion chamber 8 is not limited to measuring the heat generation rate.

The above explained preferred embodiments are exemplary of the invention of the present application which is described solely by the claims appended below. It should be understood that modifications of the preferred embodiments may be made as would occur to one of skill in the art.

What is claimed is:

1. An internal combustion engine control apparatus comprising:

a calculation function of calculating an energy generation rate of an energy generated by combustion of fuel injected into a combustion chamber of a compression-ignition internal combustion engine; and an ignition detection function of detecting an ignition timing of said fuel in said combustion chamber on the basis of a timing at which said energy generation rate exceeds a first threshold value;

wherein, when said energy generation rate due to a main injection, which is an object of ignition timing detection by said ignition detection function, exceeds said first threshold value at a plurality of timings, said ignition detection function determines an earliest one of said plurality of said timings as said ignition timing of said main injection.

2. The internal combustion engine control apparatus according to claim 1, further comprising an injection function of performing a fuel injection one time or a plurality of times within one combustion cycle into said combustion chamber, wherein, when said injection function performs a plurality of injections within said one combustion cycle, said ignition detection function identifies, as said main injection, one of said plurality of said injections, a fuel injection amount by which is larger than any of fuel injection amounts by the other of said plurality of said injections, and as said main injection, and when said injection function performs a one time injection within said one combustion cycle, identifies said one time ignition as said main injection.

3. The internal combustion engine control apparatus according to claim 2, wherein said ignition detection function includes an estimation function estimating an energy generation period with said main injection on the basis of at least one of a running state of said internal combustion engine and said energy generation rate calculated by said calculation function.

4. The internal combustion engine control apparatus according to claim 3, wherein said estimation function estimates said energy generation period with said main injection on the basis of a rotational speed and a load of said internal combustion engine, and the number of injections within said one combustion cycle.

5. The internal combustion engine control apparatus according to claim 3, wherein, when there is a plurality of time periods during each of which said energy generation rate is above a second threshold value smaller than said first threshold value, said estimation function detects, as said energy generation period with said main injection, the longest one of said plurality of said time periods.

6. The internal combustion engine control apparatus according to claim 3, wherein said estimation function estimates said energy generation period with said main injection on the basis of an integrated value of said energy generation rate calculated by said first function.

7. The internal combustion engine control apparatus according to claim 2, wherein said ignition detection function includes a peak detection function detecting a peak timing at which said energy generation rate peaks, and is configured to detect, as said ignition timing, one of a plurality of timings at each of which said energy generation rate rises from below a predetermined value smaller than said first threshold value to above said first threshold value, said one of said plurality of timings being closest to said peak timing.

8. The internal combustion engine control apparatus according to claim 1, further comprising a correction function of correcting a manipulation amount of an actuator controlling an output power of said internal combustion engine in accordance with said ignition timing detected by said ignition detection function.

* * * * *